US009589712B2

(12) United States Patent
Miyamura et al.

(10) Patent No.: US 9,589,712 B2
(45) Date of Patent: Mar. 7, 2017

(54) IRON-BASED SOFT MAGNETIC POWDER AND PRODUCTION METHOD THEREOF

(71) Applicant: Kobe Steel, Ltd., Kobe-shi (JP)

(72) Inventors: Takeo Miyamura, Kobe (JP); Hiroyuki Mitani, Kobe (JP); Hirofumi Hojo, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 13/709,598

(22) Filed: Dec. 10, 2012

(65) Prior Publication Data

US 2013/0181804 A1 Jul. 18, 2013

(30) Foreign Application Priority Data

Jan. 12, 2012 (JP) ..... 2012-004465
Jul. 20, 2012 (JP) ..... 2012-162111

(51) Int. Cl.
*H01F 1/01* (2006.01)
*H01F 3/08* (2006.01)
(Continued)

(52) U.S. Cl.
CPC ..... *H01F 1/01* (2013.01); *H01F 1/344* (2013.01); *H01F 3/08* (2013.01); *H01F 41/02* (2013.01);
(Continued)

(58) Field of Classification Search
CPC ..... H01F 3/08; H01F 41/02
(Continued)

(56) References Cited

U.S. PATENT DOCUMENTS 5,135,586 A 8/1992 Meguro et al.
5,352,268 A 10/1994 Meguro et al.
(Continued)

FOREIGN PATENT DOCUMENTS

CN 1845805 A 10/2006
EP 1 675 137 6/2006
(Continued)

OTHER PUBLICATIONS

Salak et al, "Machinability of Powder Metallurgy Steels", first published 2005, pp. 15-17 (ISBN 1-898326-82-7).
(Continued)

*Primary Examiner* — Jie Yang
(74) *Attorney, Agent, or Firm* — Oblon, McClelland, Maier & Neustadt, L.L.P.

(57) ABSTRACT

Disclosed is an iron-based soft magnetic powder obtained by preparing an iron-oxide-based soft magnetic powder through water atomization, and thermally reducing the iron-oxide-based soft magnetic powder. The iron-based soft magnetic powder has an average particle size of 100 μm or more and has an interface density of more than 0 $\mu m^{-1}$ and less than or equal to $2.6\times10^{-2}$ $\mu m^{-1}$, where the interface density is determined from a cross-sectional area ($\mu m^2$) and a cross-sectional circumference (μm) of the iron-based soft magnetic powder. The iron-based soft magnetic powder obtained by preparing an iron-oxide-based soft magnetic powder through water atomization and thermally reducing the iron-oxide-based soft magnetic powder, when used for the production of a dust core, can give a dust core having a low coercive force. Also disclosed is a duct core having a low coercive force and exhibiting superior magnetic properties.

5 Claims, 4 Drawing Sheets

(51) Int. Cl.
*H01F 41/02* (2006.01)
*H01F 1/34* (2006.01)

(52) U.S. Cl.
CPC .. *H01F 41/0246* (2013.01); *Y10T 428/12181* (2015.01)

(58) Field of Classification Search
USPC ..... 75/343
See application file for complete search history.

(56) References Cited

U.S. PATENT DOCUMENTS

| | | | | |
|---|---|---|---|---|
| 6,638,335 | B2 * | 10/2003 | Ozaki | C22C 38/004 75/255 |
| 2003/0070508 | A1 | 4/2003 | Ozaki et al. | |
| 2006/0214138 | A1 | 9/2006 | Ye et al. | |
| 2007/0102066 | A1 * | 5/2007 | Toyoda et al. | 148/104 |
| 2008/0061264 | A1 | 3/2008 | Maeda et al. | |
| 2009/0295518 | A1 | 12/2009 | Nishi et al. | |
| 2010/0150768 | A1 * | 6/2010 | Fujita et al. | 419/10 |
| 2011/0045174 | A1 | 2/2011 | Maeda et al. | |
| 2014/0205485 | A1 | 7/2014 | Nishi et al. | |

FOREIGN PATENT DOCUMENTS

| | | | |
|---|---|---|---|
| EP | 2 153 921 | | 2/2010 |
| JP | 3-223401 | | 10/1991 |
| JP | 2003-086415 | | 3/2003 |
| JP | 2003-171741 | | 6/2003 |
| JP | 2005-146315 | | 6/2005 |
| JP | 2005-281805 | A | 10/2005 |
| JP | 2006-302958 | | 11/2006 |
| JP | 2007-505216 | | 3/2007 |
| JP | 2009-200325 | A | 9/2009 |
| JP | 2010-010673 | | 1/2010 |
| JP | 2010-016290 | A | 1/2010 |
| JP | 2011-114321 | | 6/2011 |
| JP | 2011-202213 | A | 10/2011 |

OTHER PUBLICATIONS

"Powder for Dust Core with Low Iron Loss", Kobe Steel Engineering Reports, vol. 60, No. 2 (Aug. 2010)—pp. 79-83.

Ferrous powders iron powder manufacturer—Pometon Powder at http://www.pometon.com/materialsFerrous_eng.php accessed Oct. 15, 2015 1 p.

Iron Powder Reduced-Pometon Powder at http://www.pometon.com/materialsDetails_org.php/family=Ferrous/id_cat=1/id_soft . . . Accessed Oct. 15, 2015 1 p.

Iron Powder Standard-Pometon Powder at http://www.pometon.com/materialsDetails_org.php/family=Ferrous/id_cat=1/id_soft . . . Accessed Oct. 15, 2015 1 p.

Björn Uhrenius, Powder Metallurgy, Materials Science and Engineering ,KTH Royal Institute of Technology, Stockholm 2000 pp. 63-64 (w/ partial English translation).

* cited by examiner

IRON-BASED SOFT MAGNETIC POWDER AND PRODUCTION METHOD THEREOF

FIELD OF INVENTION

The present invention relates to: a dust core; an iron-based soft magnetic powder for use in production of the dust core; and production methods of the dust core and of the iron-based soft magnetic powder. Such dust cores are used typically for electromagnetic components such as motors, actuators, and reactors (inductors).

BACKGROUND OF INVENTION

Motors and other electromagnetic components are often used in alternating magnetic fields and employ magnetic cores (core materials). Such magnetic cores have been produced by stacking electromagnetic steel sheets to give a laminate and processing the resulting laminate. The magnetic cores obtained by processing electromagnetic steel sheets are, however, magnetically anisotropic, and this impedes designing of electromagnetic components having three-dimensional magnetic circuits. To avoid this, production of dust cores by compacting an iron-based soft magnetic powder has been recently investigated. This is because such dust cores are magnetically isotropic and enable designing of electromagnetic components having three-dimensional magnetic circuits.

Production of dust cores employs a powder including an iron-based soft magnetic powder covered with an insulating coating. Coverage of an iron-based soft magnetic powder with an insulating coating suppresses the generation of an inter-granular eddy current and thereby gives a dust core with a lower eddy current loss. However, the iron-based soft magnetic powder covered with the insulating coating disadvantageously gives a dust core having a high coercive force, a large hysteresis loss, and insufficient magnetic properties, because interfaces between the coated powder particles impede the flow of magnetic flux.

Techniques for reducing the coercive force to improve magnetic properties of dust cores can be found typically in Japanese Unexamined Patent Application Publication (JP-A) No. H03-223401, JP-A No. 2011-114321, and JP-A No. 2006-302958.

Specifically, JP-A No. H03-223401 mentions that a magnetic card is coated with a coating including a fine powder of a high-permeability material for the purpose of magnetic shielding and that the coating powder should have a high magnetic permeability, be a fine powder, and have a flattened shape. However, such a flattened powder, when compacted, is orientated, and this adversely affects the advantage of dust cores, i.e., magnetic isotropy.

JP-A No. 2006-302958 mentions that a specific soft magnetic material can give a compact having higher strengths with a lower eddy current loss, which soft magnetic material has a ratio of a maximum diameter to an equivalent circle diameter of more than 1.0 and equal to or less than 1.3 and has a specific surface area of 0.10 $m^2/g$ or more. This literature also mentions that a water-atomized powder has a large number of projections on the surface and, when it is used as metal magnetic particles, the surface of the water-atomized powder is worn out with a ball mill to remove the projections.

JP-A No. 2011-114321 discloses soft magnetic particles having a degree of sphericity of 0.9 or more, a coercive force of 500 Oe or less, and an apparent density of 1.6 $g/cm^3$ or more. This literature mentions that soft magnetic particles, when suitably controlled on degree of sphericity, coercive force, and apparent density and when used as a material for a dust core, gives a dust core which has a lower hysteresis loss and a lower eddy current loss and exhibits high strengths. The literature also mentions that soft magnetic particles are spheroidized by molding a material of the soft magnetic particles into pellets, firing the pellets, pulverizing the burned product, and supplying the pulverized product into flame to melt the pulverized product in a suspending state to thereby form spherical particles.

However, the techniques disclosed in JP-A No. 2006-302958 and JP-A No. 2011-114321 require a granulation step for spheroidizing a soft magnetic material and thereby fail to reduce production cost.

SUMMARY OF INVENTION

Technical Problem

Iron-based powders may be produced by pulverizing a bulk metal, or by gas atomization, or by preparing an iron-oxide-based powder through water atomization, and thermally reducing the iron-oxide-based powder.

FIG. 1, FIG. 2, and FIG. 3 depict optical photomicrographs of an iron-based powder produced by pulverization of a bulk metal; an iron-based powder produced by gas atomization; and an iron-oxide-based powder produced by water atomization, respectively. Particles of the iron-based powder produced by pulverization of a bulk metal have angular shapes (FIG. 1); particles of the iron-based powder produced by gas atomization have substantially spheroidal shapes (FIG. 2); and particles of the iron-oxide-based powder produced by water atomization have rounded irregular shapes (FIG. 3). These particles can be visually distinguished from one another.

Production of an iron-based powder by pulverization of a bulk metal is easily applicable to sendust and other fragile materials, but is hardly applicable to regular soft magnetic materials. This is because regular soft magnetic materials are not fragile and it is difficult to pulverize bulk materials made of soft magnetic materials to thereby give iron-based soft magnetic powders.

In contrast, production by gas atomization or water atomization is applicable to iron-based soft magnetic powders. Particles of an iron-based soft magnetic powder produced by gas atomization have approximately spherical shapes, as illustrated in FIG. 2. It is known that an iron-based soft magnetic powder itself has a decreasing coercive force with a shape approaching a spherical shape. However, the iron-based soft magnetic powder having a shape approaching a spherical shape disadvantageously gives a dust core having lower strengths, because particles of the iron-based soft magnetic powder having approximately spherical shapes are less physically entangled with one another upon compacting.

By contrast, particles of an iron-based soft magnetic powder obtained by water atomization have rounded irregular shapes as illustrated in FIG. 3 and thereby give a dust core having higher mechanical strengths, because the particles are entangled with one another upon compacting. Production by water atomization can be performed at low cost and is more suitable for industrial production than the gas atomization is. However, an iron-based soft magnetic powder obtained by water atomization tends to have a larger coercive force than that of an iron-based soft magnetic powder obtained by gas atomization.

For these reasons, reduction in coercive force of an iron-based soft magnetic powder obtained by water atomization is considered to enable low-cost production of a dust core having superior magnetic properties and exhibiting high mechanical strengths.

The present invention has been made under these circumstances, and an object thereof is to provide an iron-based soft magnetic powder for dust cores, which is produced by preparing an iron-oxide-based soft magnetic powder through water atomization and reductively heat-treating the iron-oxide-based soft magnetic powder and which can give a dust core having a low coercive force.

Another object of the present invention is to provide a dust core having a low coercive force and exhibiting superior magnetic properties.

Solution to Problem

The present invention has achieved the objects and provides, in an aspect, an iron-based soft magnetic powder obtained by preparing an iron-oxide-based soft magnetic powder through water atomization, and thermally reducing the iron-oxide-based soft magnetic powder, in which the iron-based soft magnetic powder has an average particle size of 100 μm or more, and the iron-based soft magnetic powder has an interface density of more than 0 $\mu m^{-1}$ and less than or equal to $2.6\times10^{-2}$ $\mu m^{-1}$, where the interface density is determined from a cross-sectional area ($\mu m^2$) and a cross-sectional circumference (μm) of the iron-based soft magnetic powder according to following Expression (1):

$$\text{Interface density}=\Sigma(\text{cross-sectional circumferences of iron-based soft magnetic powder particles})/2/\Sigma(\text{cross-sectional areas of iron-based soft magnetic powder particles}) \quad (1)$$

The present invention also includes a dust core produced by using the iron-based soft magnetic powder.

The present invention provides, in another aspect, a dust core derived from an iron-based soft magnetic powder obtained by preparing an iron-oxide-based soft magnetic powder through water atomization, and thermally reducing the iron-oxide-based soft magnetic powder, in which the dust core has a number density of discontinuous particle interfaces of 200 or less per square millimeter of an observation field of view, and the discontinuous particle interfaces are observed in iron-based soft magnetic powder particles present in a cross section of the dust core and are each derived from a surface of one iron-based soft magnetic powder particle and formed through contact of different regions of the surface with each other.

An iron-based soft magnetic powder according to an embodiment of the present invention may be produced by a method including preparing an iron-oxide-based soft magnetic powder through water atomization, and thermally reducing the iron-oxide-based soft magnetic powder. This production method includes the steps of controlling particle size of the iron-oxide-based soft magnetic powder so as to have a mass-cumulative particle size $D_{10}$ of 50 μm or more; and thermally reducing the size-controlled iron-oxide-based soft magnetic powder at 850° C. or higher to give an iron-based soft magnetic powder. The method according to the present invention may further include the step of controlling particle size of the iron-based soft magnetic powder obtained from the thermal reduction step, so as to have an average particle size of 100 μm or more. A dust core according to an embodiment of the present invention may be produced by compacting the iron-based soft magnetic powder to give a powder compact, and thermally treating the powder compact.

Advantageous Effects of Invention

The present invention controls an iron-based soft magnetic powder having an average particle size of 100 μm or more so as to have an interface density at a predetermined level or less, which interface density is determined from a cross-sectional area and a cross-sectional circumference of the iron-based soft magnetic powder, i.e., a cross-sectional circumference per unit cross-sectional area. This iron-based soft magnetic powder gives a dust core having a low coercive force and exhibiting superior magnetic properties. A dust core according to another embodiment of the present invention has a number density of discontinuous particle interfaces of 200 or less per square millimeter of an observation field of view, thereby has a low coercive force, and exhibits superior magnetic properties. The present invention employs, as an iron-based soft magnetic powder, one produced by preparing an iron-oxide-based soft magnetic powder through water atomization, and thermally reducing the iron-oxide-based soft magnetic powder, and thereby provides a dust core having higher strengths at a lower cost than one produced by using an iron-based soft magnetic powder obtained typically through gas atomization.

DETAILED DESCRIPTION OF THE PREFERRED EMBODIMENTS

Figure 1:
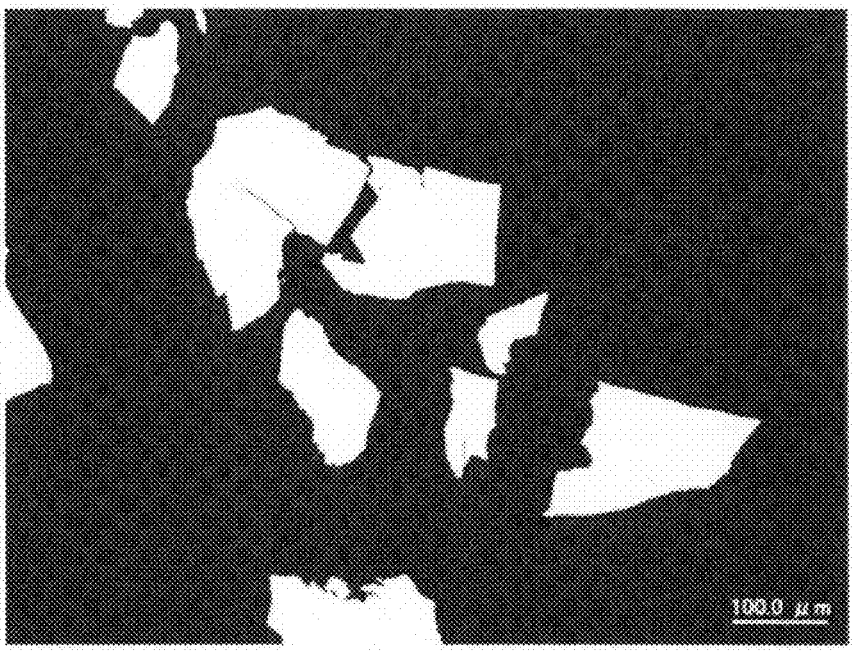
FIG. 1 depicts a photomicrograph of an iron-based powder produced by pulverization of a bulk metal.
Figure 2:
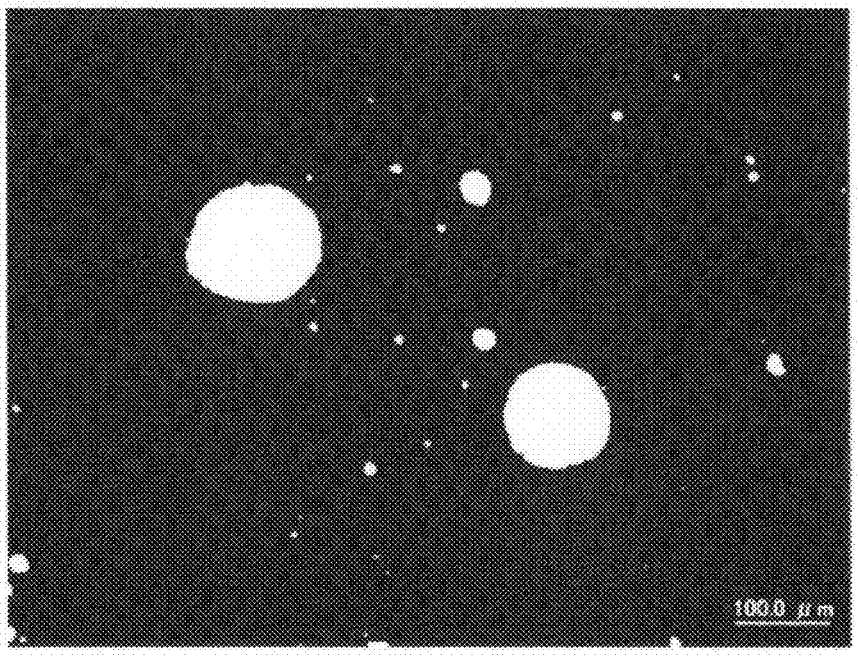
FIG. 2 depicts a photomicrograph of an iron-based powder produced by gas atomization.
Figure 3:
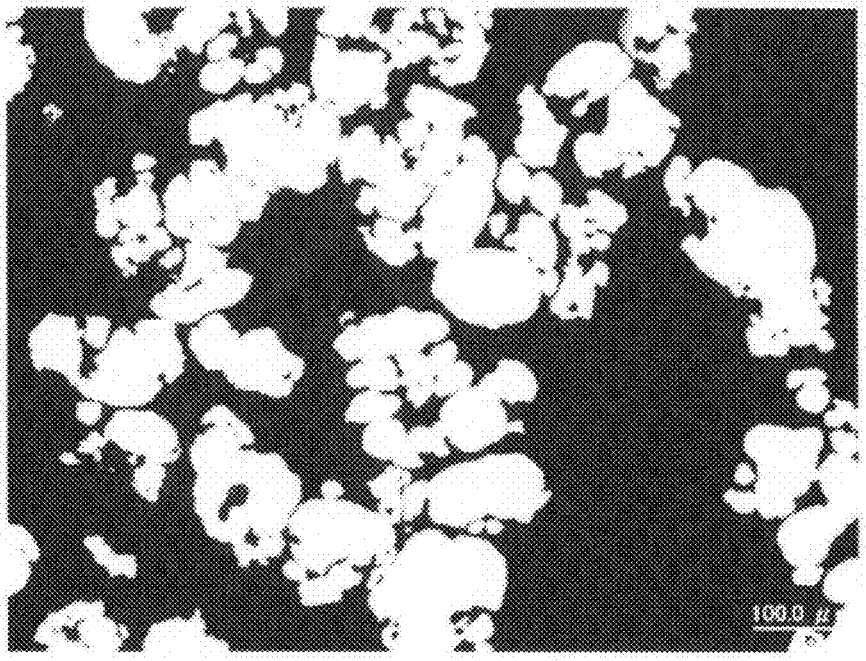
FIG. 3 depicts a photomicrograph of an iron-oxide-based powder produced by water atomization.

The present inventors made intensive investigations to allow an iron-based soft magnetic powder to have a lower coercive force and to thereby provide such an iron-based soft magnetic powder for dust core use as to give a dust core having a low coercive force, in which the iron-based soft magnetic powder is produced by preparing an iron-oxide-based soft magnetic powder through water atomization, and thermally reducing the iron-oxide-based soft magnetic powder. As a result, the present inventors have found that, when an iron-based soft magnetic powder is produced by preparing an iron-oxide-based soft magnetic powder through water atomization and thermally reducing the iron-oxide-based soft magnetic powder, particles of the resulting iron-based soft magnetic powder are present as secondary particles, in which two or more partially sintered particles apparently behave as one particle (one secondary particle); that these secondary particles accordingly adversely affect the coercive force of a dust core; and that a dust core can have a lower coercive force by controlling an iron-based soft magnetic powder to have an average particle size of 100 μm or more and to have an interface density at a predetermined level or less, which interface density is determined from a cross-sectional area and a cross-sectional circumference of the iron-based soft magnetic powder. The present inventors have also found that discontinuous particle interfaces are observed in iron-based soft magnetic powder particles present in a cross section of a dust core, which discontinuous particle interfaces are derived from a surface of the iron-based soft magnetic powder and formed by different regions of the surface being in contact with each other, that a number density of the discontinuous particle interfaces is in correlation with the coercive force of a dust core; and that an iron-based soft magnetic powder having a number density of discontinuous particle interfaces of 200 or less per square millimeter of an observation field of view can give a dust core having a lower coercive force and exhibiting better magnetic properties. The present invention has been made based on these findings. The present invention will be illustrated in detail below.

Initially, iron-based soft magnetic powders according to embodiments of the present invention will be illustrated.

An iron-based soft magnetic powder according to an embodiment of the present invention has an average particle size of 100 μm or more. Specifically, when a dust core is used in an alternating magnetic field particularly of a low frequency (e.g., several tens of hertz to one thousand hertz), hysteresis loss occupies a large proportion of core loss occurring in the dust core, and the dust core requires a lower coercive force to reduce the hysteresis loss. A coarse iron-based soft magnetic powder is known to have a low coercive force and to thereby give a dust core having a low coercive force. Accordingly, the present invention employs an iron-based soft magnetic powder having a large particle size (being coarse) in terms of an average particle size of 100 μm or more. The iron-based soft magnetic powder has an average particle size of preferably 110 μm or more and more preferably 120 μm or more. An upper limit of the particle size is typically about 300 μm. This is because excessively coarse particles are difficult to be charged into corners of a die, and, to avoid this, upper limits of particle sizes are generally set on magnetic iron powders.

Use of an iron-based soft magnetic powder having an average particle size of 100 μm or more can give a dust core having a lower coercive force. Another important feature of the iron-based soft magnetic powder according to the present invention is control of an interface density to be $2.6\times10^{-2}$ $\mu m^{-1}$ or less, where the interface density is determined from a cross-sectional area ($\mu m^2$) and a cross-sectional circumference (μm) of the iron-based soft magnetic powder according to following Expression (1):

$$\text{Interface density}=\Sigma(\text{cross-sectional circumferences of iron-based soft magnetic powder particles})/2/\Sigma(\text{crass-sectional areas of iron-based soft magnetic powder particles}) \quad (1)$$

The iron-based soft magnetic powder according to the present invention will be illustrated below with reference to reasons why the interface density is specified.

Water atomization brings a molten metal into contact with water and gives a powder being oxidized. An iron-oxide-based powder obtained by water atomization is generally thermally reduced by heating (e.g., at a temperature of 850° C. or higher) in a reductive atmosphere or in a non-oxidative atmosphere such as a hydrogen gas atmosphere and an inert gas atmosphere (e.g., a nitrogen gas atmosphere or an argon gas atmosphere).

Thermal reduction (reducing heat treatment) of an iron powder at a high temperature induces sintering of particles of the iron powder with one another to give a partially sintered preform. In general, the partially sintered preform after thermal reduction is crushed (pulverized) using a crusher. Even crushing, however, fails to completely separate sintered iron powder particles from one another and leaves secondary particles each including partially sintered several particles in varying sizes. An iron-based soft magnetic powder containing the secondary particles, when compacted, gives a dust core which contains particle interfaces in a high density and which has a large coercive force, because the particle interfaces in a high density impede domain wall motion.

Figure 4:
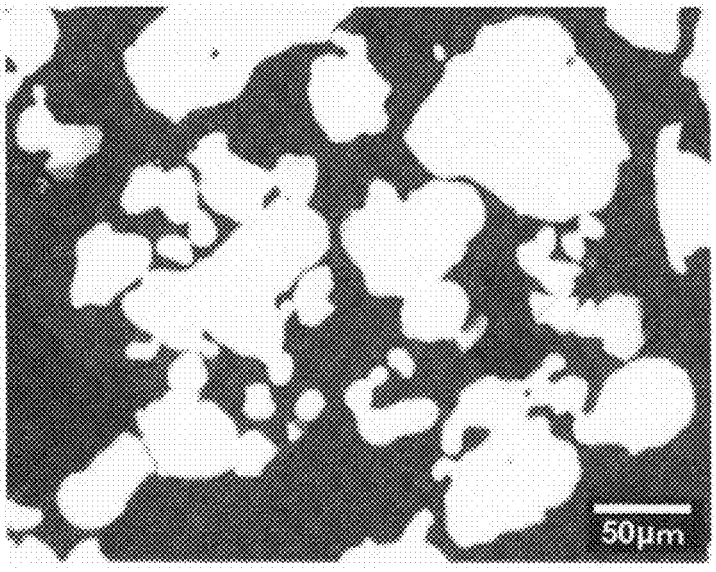
FIG. 4 depicts a photomicrograph of a cross section of representative secondary particles in a powder produced by water atomization.

FIG. 4 is an optical photomicrograph of representative examples of secondary particles. A feature of such a secondary particle is that the secondary particle has a concave portion in its outer shape which is formed by a surface of one continuous particle (secondary particle) and is inwardly largely embedded. The secondary particle has an actual cross-sectional circumference larger than an equivalent circle circumference. The equivalent circle circumference is a circumference of an assumed perfect circle having an area equal to the cross-sectional area of the particle.

Figure 5A:
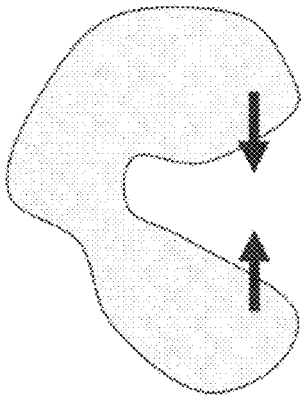
FIGS. 5A and 5B depict schematic diagrams illustrating how an interface derived from a surface of a particle is formed in the particle through contact of different regions of the particle surface with each other upon compacting of secondary particles.
Figure 5B:
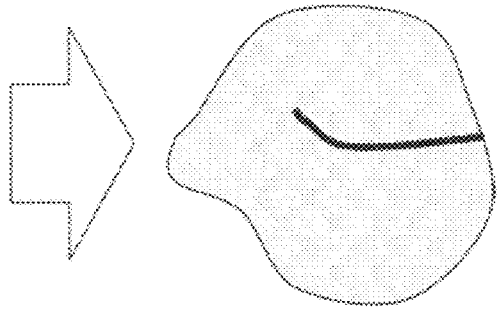

When such a secondary particle as illustrated in FIG. 5A is compacted, the concave portion of the particle is crushed, and a partial region of the particle surface is taken within the particle to form a new interface in the particle as illustrated in FIG. 5B. Specifically, spherical particles, when compacted, come into contact with one another to form only interfaces each between adjacent particles; but secondary particles as illustrated in FIG. 5A form not only interfaces between adjacent particles but also interfaces inside the particles as illustrated in FIG. 5B. Thus, secondary particles have a higher interface density than that of spherical particles. An iron-based soft magnetic powder for use in an alternating magnetic field is generally coated with an insulating coating so as to have a lower eddy current loss. Accordingly, the interfaces formed in the particles do not disappear even through a heat treatment after compacting, because the presence of the insulating coating impedes sintering of iron with each other. Such interfaces impede domain wall motion, and a dust core, if having a higher internal interface density, has a larger coercive force.

The internal interface density of a dust core (density of interfaces inside the dust core) may probably be unambiguously determined by the particle size distribution of a material iron-based soft magnetic powder. Specifically, an iron-based soft magnetic powder may have an increasing interface density with a decreasing particle size and may have a decreasing interface density with an increasing particle size. However, an iron-based soft magnetic powder, if including the secondary particles, may have a higher interface density proportionately with interfaces formed in particles derived from the secondary particles, even when the particle size is controlled. The coercive force of the resulting dust core is therefore affected by the shapes and amount of secondary particles even when the particle size is controlled at a certain level.

Accordingly, the present inventors focused attention on the cross-sectional area and cross-sectional circumference of an iron-based soft magnetic powder and considered that a dust core could have a lower coercive force by suitable control of the cross-sectional circumference of the iron-based soft magnetic powder per unit cross-sectional area (i.e., interface density). Specifically, during deformation process of particles upon compacting as described above, spherical particles come in contact with other particles and deform to form interfaces; whereas in secondary particles upon compacting, concave portions formed by partial regions of the particle surface depressed inwardly are compressed, and different regions of the surface of one particle come into contact with each other to form an interface inside the particle. Measurement of circumferences of secondary particles may enable calculation of an internal interface density of the resulting dust core. It is difficult to three-dimensionally grasp the shapes of particles of an iron-based soft magnetic powder, and the interface density herein is therefore calculated according to Expression (1) based on the cross-sectional shapes (two-dimensional shapes) of iron-based soft magnetic powder particles.

In Expression (1), Σ represents the total sum of values in question of two or more particles. In the present invention, at least 100 particles of a sample iron-based soft magnetic powder are subjected to measurements of cross-sectional area and cross-sectional circumference. The total sum of cross-sectional circumferences of particles of iron-based soft magnetic powder is divided by 2 in Expression (1). This is because the surface of a particle comes in intimate contact with the surface of another particle, and thereby two particles form one interface.

The cross-sectional areas and cross-sectional circumferences of particles of an iron-based soft magnetic powder may be measured by embedding the iron-based soft magnetic powder in a resin, polishing the resin, taking a photograph of an arbitrarily selected polished surface under an optical microscope, and analyzing the image of photograph. When iron powder particles are embedded in a resin, a cross section of a particle observed at a polished surface (observation face) may correspond to a cross section of an end portion of the particle in some cases. To avoid such end-portion cross sections from measurement, particles having an equivalent circle diameter of 10 μm or more are to be measured herein, among particles observed at the polished surface.

The iron-based soft magnetic powder should have an interface density as measured above of $2.6\times10^{-2}$ $\mu m^{-1}$ or less and may have an interface density of preferably $2.3\times10^{-2}$ $\mu m^{-1}$ or less, and more preferably $2.2\times10^{-2}$ $\mu m^{-1}$ or less.

The present invention specifies the interface density in a dust core calculated from surface density of the original iron-based soft magnetic powder. This is because, when the iron-based soft magnetic powder is compacted to give a dust core, interfaces derived from the surfaces of secondary particles and formed in the secondary particles often break off as illustrated in FIG. 5B, and this impedes quantitative determination of the interface density of the dust core even through observation of the cross section of the dust core after compacting. Wadell sphericity as mentioned below is known as an index to express the shape of a powder. This index, however, expresses a macroscopic shape of the powder, significantly depends on the maximum length of the powder, and is not suitable as an index for expressing the shape of a secondary particle as in the present invention.

Wadell sphericity=(Diameter of circle having an area equal to projected area)/(Diameter of minimum circumscribed circle)

Dust cores according to embodiments of the present invention will be illustrated below.

A dust core according to an embodiment of the present invention is a dust core derived from an iron-based soft magnetic powder obtained by preparing an iron-oxide-based soft magnetic powder through water atomization, and thermally reducing the iron-oxide-based soft magnetic powder. The dust core has a number density of discontinuous particle interfaces of 200 or less per square millimeter of an observation field of view, in which the discontinuous particle interfaces are observed in iron-based soft magnetic powder particles present in a cross section of the dust core and are each derived from a surface of one iron-based soft magnetic powder particle and formed through contact of different regions of the surface with each other.

Figure 7:
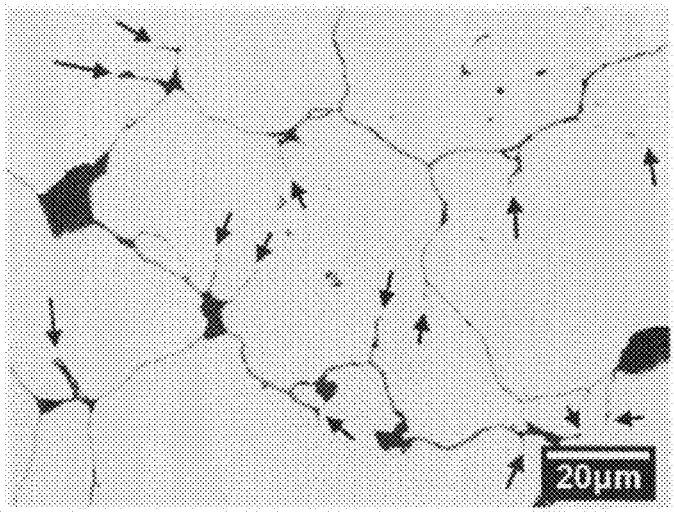
FIG. 7 depicts a photomicrograph of cross section of a dust core of Sample No. 2 in Table 1.

As used herein the term "discontinuous particle interface" refers to an interface which is derived from a surface of one iron-based soft magnetic powder particle and formed through contact of different regions of the surface with each other and which is present inside the iron-based soft magnetic powder, as illustrated in FIG. 5B. FIG. 7 depicts a photomicrograph of the discontinuous particle interface, which was taken on the cross section of a dust core of No. 2 in Table 1 in working examples mentioned below. Arrows illustrated in FIG. 7 indicate positions of discontinuous particle interfaces.

The present inventors made investigations on a relationship between the number density of the discontinuous particle interfaces and the coercive force of a dust core and found that these factors are correlative to each other; and that the dust core has a decreasing coercive force and better magnetic properties with a decreasing number density of the discontinuous particle interfaces. Specifically, they found that, when the discontinuous particle interfaces were present in a number density of more than 200 per square millimeter of an observation field of view, the resulting dust core had a large coercive force and inferior magnetic properties. Based on these findings, the dust core according to the present invention has a number density of discontinuous particle interfaces of 200 or less per square millimeter of an observation field of view. The dust core preferably has a number density of discontinuous particle interfaces of 120 or less per square millimeter.

The number density of discontinuous particle interfaces may be measured by microscopically observing a cross section of a sample dust core, which cross section has been polished to a mirror-smooth state. Polishing of the cross section of the dust core to a mirror-smooth state may be performed through buffing with a slurry or paste. Observation of the cross section may be performed with an optical microscope or scanning electron microscope. Observation may be performed at a magnification of 50 to 500 times at three or more observation fields of view, followed by averaging.

Upon observation, there is no need for etching of the cross section. This is because the iron-based soft magnetic powder is generally coated with an insulating coating, and particle interfaces can be observed upon buffing even without etching. In other words, etching, if performed, may contrarily impede differentiation between grain boundaries and particle interfaces of iron-based soft magnetic powder particles.

Control of a dust core to have a number density of the discontinuous particle interfaces within the above-specified range may be performed by producing the dust core using an iron-based soft magnetic powder having an interface density of $2.6\times10^{-2}$ $\mu m^{-1}$ or less.

Next, a method for producing an iron-based soft magnetic powder according to an embodiment of the present invention will be illustrated. The iron-based soft magnetic powder can be produced by a method including the steps of preparing an iron-oxide-based soft magnetic powder through water atomization, and thermally reducing the iron-oxide-based soft magnetic powder. Specifically, the method further includes the steps of controlling particle size of the iron-oxide-based soft magnetic powder so as to have a mass-cumulative particle size $D_{10}$ of 50 μm or more; and thermally reducing the size-controlled iron-oxide-based soft magnetic powder at 850° C. or higher to give an iron-based soft magnetic powder. As used herein the term "particle size $D_{10}$" refers to the 10% mass-cumulative particle diameter for which 10% (by mass) of the entire particles in a sample powder are finer.

Step of Preparing Iron-Oxide-Based Soft Magnetic Powder

An iron-oxide-based soft magnetic powder is prepared through water atomization according to the present invention. Water atomization may be performed under known conditions, to give a powder which is oxidized on its surface.

The iron-oxide-based soft magnetic powder to be prepared herein is not limited, as long as giving a ferromagnetic iron-based powder as a result of thermal reduction (reducing heat treatment) described later. Specifically, exemplary ferromagnetic iron-based powder include pure iron powder, iron-based alloy powders (powders of Fe—Al alloys, Fe—Si alloys, sendust, and permalloys), and iron-based amorphous powders.

Step of Controlling Particle Size

Importantly, particle size control (grading) of the iron-oxide-based soft magnetic powder obtained through water atomization is performed herein so as to have a mass-cumulative particle size $D_{10}$ of 50 μm or more. Specifically, most of secondary particles are formed by partial sintering of fine particles and contacting/bonding of adjacent particles during the thermal reduction step described later. Accordingly, removal of fine powder particles prior to thermal reduction may probably impede the formation of secondary particles. For this reason, particles of the iron-oxide-based soft magnetic powder are size-controlled so as to have a mass-cumulative particle size $D_{10}$ of 50 μm or more (preferably 80 μm or more).

As used herein the term "mass-cumulative particle size $D_{10}$" refers to the 10% mass-cumulative particle diameter for which 10% (by mass) of the entire particles in a sample powder are finer in a particle size distribution of the powder.

The particle size $D_{10}$ may be determined typically by determining a particle size distribution through laser diffraction/scattering or sieve classification, and calculating the particle size $D_{10}$ based on the particle size distribution.

Figure 6A:
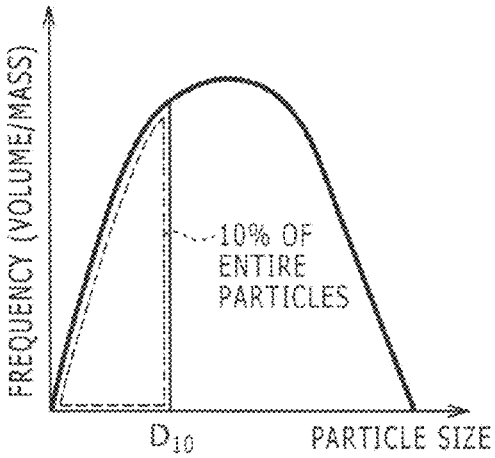
FIGS. 6A and 6B depict schematic diagrams illustrating how to determine a particle size $D_{10}$.

FIG. 6A depicts an exemplary determination of a particle size distribution through laser diffraction/scattering. With reference to FIG. 6A, laser diffraction/scattering continuously measures a particle size distribution. This enables determination of the particle size $D_{10}$ by reading the particle diameter at which a cumulative mass (or cumulative volume) occupies 10% of the entire particles.

Figure 6B:
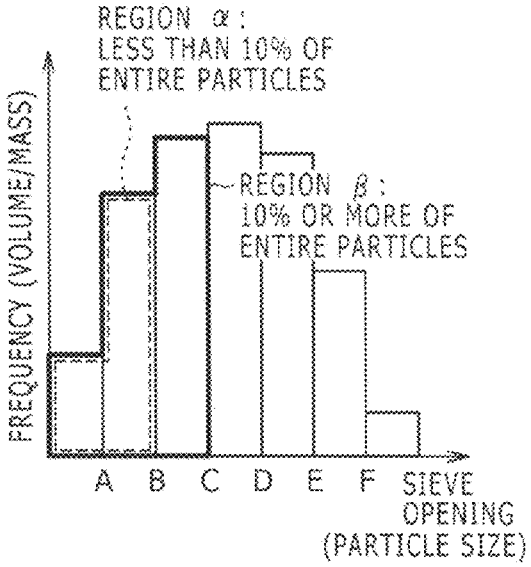

FIG. 6B depicts an exemplary determination of a particle size distribution through sieve classification. With reference to FIG. 6B, the sieve classification measures a particle size distribution by sieving particles using plural sieves A, B, C, D, E, and F having different openings, and measuring the mass of powder particles for each particle size. Typically, it is verified that the particle size $D_{10}$ falls within a range between openings B and C when the mass percentage of the region α (region enclosed by a dotted line) indicated in FIG. 6B is less than 10% of the mass of entire powder particles subjected to sieving, and the mass percentage of the region β (region enclosed by a heavy line) is 10% or more of the mass of entire powder particles subjected to sieving. Based on this, whether an iron-oxide-based soft magnetic powder has a particle size $D_{10}$ of 50 μm or more can be verified by subjecting the iron-oxide-based soft magnetic powder to classification using a sieve of an opening of 49 μm, and determining whether the mass of powder particles passing through the sieve is more than 10% of the mass of the entire powder particles subjected to sieving.

Particle size control of the iron-oxide-based soft magnetic powder may be performed by subjecting the iron-oxide-based soft magnetic powder to sieve classification, and removing powder particles typically of 45 μm or less, 75 μm or less, 100 μm or less, or 150 μm or less.

The mass-cumulative particle size $D_{10}$ has been described above. However, particle size control of the iron-oxide-based soft magnetic powder may also be performed in the following manner. A volume-cumulative particle size $D_{10}$ is determined based on a cumulative volume instead of cumulative mass, and particle size control is performed so as to allow the iron-oxide-based soft magnetic powder to have a volume-cumulative particle size $D_{10}$ of 50 μm or more. This is because the mass of a powder is proportional to the volume thereof unless particles of the powder have variations in specific gravity.

Thermal Reduction Step

The resulting iron-oxide-based soft magnetic powder after particle size control is subjected to thermal reduction at a temperature of 850° C. or higher. Thermal reduction, if performed at a temperature of lower than 850° C., may substantially fail to reduce the iron-oxide-based soft magnetic powder sufficiently. With an elevating thermal reduction temperature, highly oxidative impurities can be removed in a larger amount, and for this reason, the thermal reduction is performed at a temperature of preferably 900° C. or higher, more preferably 1000° C. or higher, and furthermore preferably 1100° C. or higher. A thermal reduction at an excessively high temperature, however, may cause sintering to proceed excessively, and this may impede crushing of the resulting particles. To avoid this, the thermal reduction may be performed at a temperature typically of 1250° C. or lower.

The thermal reduction may be performed in a reductive atmosphere or in a non-oxidative atmosphere such as a hydrogen gas atmosphere or an inert gas atmosphere (e.g., a nitrogen gas atmosphere or an argon gas atmosphere).

The iron-based soft magnetic powder obtained by thermal reduction has a large average particle size and a low interface density and thereby gives a dust core having a low coercive force.

Next, a method for producing a dust core using the iron-based soft magnetic powder according to an embodiment of the present invention will be described.

The dust core can be produced by compacting the iron-based soft magnetic powder using a die and a pressing machine, which iron-based soft magnetic powder has been obtained through thermal reduction.

The iron-based soft magnetic powder obtained through thermal reduction is preferably subjected to particle size control so as to have an average particle size of 100 μm or more. The thermal reduction may often cause iron-oxide-based soft magnetic powder particles to be partially sintered to form a partially sintered preform. The resulting dust core can have a lower coercive force by crushing the partially sintered preform with a pulverizer or mill, and controlling particle size of the resulting powder through sieve classification so as to have an average particle size of 100 μm or more.

The iron-based soft magnetic powder obtained through thermal reduction (or the iron-based soft magnetic powder size-controlled so as to have an average particle size of 100 μm or more) is preferably covered with or coated with an insulating coating. Covering the iron-based soft magnetic powder with an insulating coating may reduce the eddy current loss occurring in an alternating magnetic field.

The insulating coating may be typified by inorganic conversion coatings such as phosphate conversion coating films and chromate conversion coating films; and resin coatings such as silicone resin coatings, phenolic resin coatings, epoxy resin coatings, polyamide resin coatings, and polyimide resin coatings. Of inorganic conversion coatings, phosphate conversion coating films are preferred. Of resin coatings, silicone resin coatings are preferred. The insulating coating may include any one of the above-listed coatings alone or include two or more different coatings laminated to form a multilayer coating.

A powder including the iron-based soft magnetic powder covered with a phosphate conversion coating film and a silicone resin coating formed in this order will be described in detail below as a specific embodiment. It should be noted, however, that this configuration is never intended to limit the scope of the invention. For the sake of convenience, a powder including the iron-based soft magnetic powder covered with a phosphate conversion coating film is hereinafter simply referred to as a "phosphate-coated iron powder"; and a powder including the phosphate-coated iron powder further coated with a silicone resin coating simply referred to as "silicone-resin-coated iron powder".

Phosphate Conversion Coating Film

The phosphate conversion coating film is not limited in its composition, as long as being a vitrified (glassy) coating formed from a phosphorus-containing compound, but is preferably a vitrified coating using a compound further containing cobalt (Co), sodium (Na), and sulfur (S) in addition to phosphorus or a compound further containing cesium (Cs) and/or aluminum (Al) in addition to phosphorus. These elements suppress iron (Fe) and oxygen from forming a semiconductor and thereby protect the iron-based powder from having a lower resistivity upon the after-mentioned heat treatment step.

When the phosphate conversion coating film is a vitrified coating formed from a compound containing Co and the other elements in addition to phosphorus, the contents of these elements are preferably 0.005 to 1 percent by mass for P, 0.005 to 0.1 percent by mass for Co, 0.002 to 0.6 percent by mass for Na, and 0.001 to 0.2 percent by mass for S based on the total mass (100 percent by mass) of the phosphate-coated iron powder. Likewise, when the phosphate conversion coating film contains Cs or Al in addition to phosphorus, the contents of Cs and Al are preferably 0.002 to 0.6 percent by mass for Cs and 0.001 to 0.1 percent by mass for Al based on the total mass (100 percent by mass) of the phosphate-coated iron powder. When the phosphate conversion coating film contains both Cs and Al, the contents of the two elements preferably fall within the above-specified ranges, respectively.

Of the elements, phosphorus forms chemical bonds through oxygen with the surface of the iron-based soft magnetic powder. Accordingly, if the phosphorus content is less than 0.005 percent by mass, the phosphate conversion coating film forms chemical bonds with the surface of the iron-based soft magnetic powder in an insufficient amount and thereby fails to be a firm coating. In contrast, when the phosphorus content is more than 1 percent by mass, phosphorus not involved in chemical bonds remains unreacted, and this may adversely affect the bonding strength contrarily.

The elements Co, Na, S, Cs, and Al suppress iron (Fe) and oxygen from forming a semiconductor and thereby protect the iron-based powder from having a lower resistivity during the heat treatment step. Co, Na, and S exhibit maximized effects when used in combination. In contrast, each of Cs and Al may be used alone. The lower limits of the contents of Co, Na, and S are minimum amounts for exhibiting effects of combination use of these elements. The elements Co, Na, S, Cs, and Al, when used in excessively high contents, may fail to maintain relative balance among them in combination use and, in addition, may probably inhibit the formation of chemical bonds between phosphorus and the surface of the iron-based soft magnetic powder through oxygen.

The phosphate conversion coating film may further contain magnesium (Mg) and/or boron (B). In this case, the contents of Mg and B are preferably both 0.001 to 0.5 percent by mass based on the total mass (100 percent by mass) of the phosphate-coated iron powder.

The phosphate conversion coating film has a thickness of preferably about 1 to about 250 nm. The phosphate conversion coating film, if having a thickness of less than 1 nm, may not exhibit sufficient insulating effects. The phosphate conversion coating film, if having a thickness of more than 250 nm, may exhibit saturated insulating effects and may disadvantageously impede the dust core in having a high density. The phosphate conversion coating film more preferably has a thickness of 10 to 50 nm.

Process for Formation of Phosphate Conversion Coating Film

A phosphate-coated iron powder for use herein may be produced according to any process. For example, the phosphate-coated iron powder may be produced by preparing a solution of a phosphorus-containing compound in a solvent including water and/or an organic solvent; mixing the solution with the iron-based soft magnetic powder; and, where necessary, evaporating the solvent.

The solvent for use in this process is typified by water; hydrophilic organic solvents such as alcohols and ketones; and mixtures of them. The solvent may further contain a known surfactant.

The phosphorus-containing compound is typified by orthophosphoric acid ($H_3PO_4$). Compounds for allowing the phosphate conversion coating film to have a composition within the above-specified range are typified by $Co_3(PO_4)_2$ (cobalt and phosphorus sources), $Co_3(PO_4)_2\ 8H_2O$ (cobalt and phosphorus sources), $Na_2HPO_4$ (phosphorus and sodium sources), $NaH_2PO_4$ (phosphorus and sodium sources), $NaH_2PO_4nH_2O$ (phosphorus and sodium sources), $Al(H_2PO_4)_3$ (phosphorus and aluminum sources), $Cs_2SO_4$ (cesium and sulfur sources), $H_2SO_4$ (sulfur source), MgO (magnesium source), and $H_3BO_3$ (boron source). Among them, sodium dihydrogenphosphate ($NaH_2PO_4$), when used as phosphorous and sodium sources, may give a dust core which is in good balance among density, strength, and resistivity.

The phosphorus-containing compound may be added to the iron-based soft magnetic powder in such an amount as to give a phosphate conversion coating film having a composition within the above-specified range. Typically, a phosphate conversion coating film having a composition within the above-specified range may be obtained by preparing a phosphorus-containing compound having a solid content of about 0.01 to about 10 percent by mass; preparing a solution containing the phosphorus-containing compound and, where necessary, an optional compound containing any of elements to be contained in the resulting coating; adding about 1 to about 10 parts by mass of the solution to 100 parts by mass of the iron-based soft magnetic powder, and mixing them with a known mixing machine. The mixing machine is typified by mixers, ball mills, kneaders, V-type mixers, and granulators.

Where necessary, the process may further include the step of drying at 150° C. to 250° C. in air under reduced pressure or under a vacuum, after the mixing step. After drying, the resulting article may be sieved through a sieve having an opening of about 200 μm to about 500 μm. These steps give a phosphate-coated iron powder bearing a phosphate conversion coating film.

Silicone Resin Coating

In an embodiment of the present invention, the iron powder may further have a silicone resin coating on the phosphate conversion coating film. This may make powder particles to be bound to each other firmly upon the completion of crosslinking/curing reaction of the silicone resin (upon compacting). In addition, this configuration may help the insulating coatings to have better thermal stability due to the formation of Si—O bonds which are highly thermally stable.

A silicone resin, if being cured slowly, may give a sticky powder and may thereby give a coating with poor handleability. To avoid this, the silicone resin for use herein is more preferably one having trifunctional units (T units) ($RSiX_3$ where X is a hydrolyzable group) than one having bifunctional units (D units) ($R_2SiX_2$ where X is as defined above). It should be noted that a silicone resin, if containing a large amount of quadrifunctional units (Q units) ($SiX_4$ where X is as defined above), may cause excessively firm binding among powder particles upon precuring, and this may impede the subsequent compacting step. To avoid these, the silicone resin has T units in an amount of preferably 60 percent by mole or more, more preferably 80 percent by mole or more, and most preferably 100 percent by mole.

Methylphenylsilicone resins, where R is methyl group or phenyl group, have been generally used as such silicone resins, and it has been believed that a methylphenylsilicone resin containing phenyl groups in a larger amount has better thermal stability. However, the present inventors have found that the presence of phenyl group is not so effective under such high-temperature heat treatment conditions as employed in the present invention. This is probably because the bulkiness of phenyl group disturbs the dense vitrified network structure and thereby contrarily lowers the thermal stability and the inhibition effect on formation of compounds with iron. In a preferred embodiment, the present invention therefore employs a methylphenylsilicone resin having methyl group in a content of 50 percent by mole or more (e.g., products under the trade names KR255 and KR311 supplied by Shin-Etsu Chemical Co. Ltd.), more preferably a methylphenylsilicone resin having methyl group in a content of 70 percent by mole or more (e.g., products under the trade name KR300 supplied by Shin-Etsu Chemical Co. Ltd.), and most preferably a methylsilicone resin having no phenyl group (e.g., products under the trade names KR251, KR400, KR220L, KR242A, KR240, KR500, and KC89 each supplied by Shin-Etsu Chemical Co. Ltd.; or products under the trade name SR2400 supplied by Dow Corning Toray Co., Ltd.). The ratio between methyl group and phenyl group and the functionality of the silicone resin (coating) may be analyzed typically through Fourier transform infrared spectroscopy (FT-IR).

The silicone resin coating may be applied in a mass of coating preferably regulated to be 0.05 percent by mass to 0.3 percent by mass based on the total amount (100 percent by mass) of the silicone-resin-coated iron powder bearing the phosphate conversion coating film and the silicone resin coating formed in this order. If the silicone resin coating present in a mass of coating of less than 0.05 percent by mass, the resulting silicone-resin-coated iron powder may have insufficient insulating properties and have a low electric resistance. In contrast, the silicone resin coating, if present in a mass of coating of more than 0.3 percent by mass, may impede the resulting dust core in having a high density.

The silicone resin coating has a thickness of preferably from 1 nm to 200 nm, and more preferably from 20 nm to 150 nm.

The total thickness of the phosphate conversion coating film and the silicone resin coating is preferably 250 nm or less. If the total thickness exceeds 250 nm, the dust core may have an insufficient magnetic flux density.

Process for Formation of Silicone Resin Coating

The silicone resin coating may be formed, for example, by mixing a silicone resin solution with an iron-based soft magnetic matrix powder bearing a phosphate conversion coating film (phosphate-coated iron powder), in which the solution is a solution of a silicone resin in an organic solvent including an alcohol, or a petroleum organic solvent such as toluene or xylene; and evaporating the organic solvent according to necessity.

The silicone resin may be added to the phosphate-coated iron powder in such an amount that the mass of coating of the formed silicone resin coating falls within the above-specified range. For example, a resin solution prepared so as to have a solid content of about 2 percent by mass to about 10 percent by mass may be added in an amount of about 0.5 percent by mass to about 10 percent by mass to 100 percent by mass of the phosphate-coated iron powder, followed by drying. If the resin solution is added in an amount of less than 0.5 percent by mass, it may take a long time for mixing, or the resulting coating may become non-uniform. In contrast, the resin solution, if added in an amount of more than 10 percent by mass, may cause an excessively long time for drying or may cause insufficient drying. The resin solution may have been heated as appropriate before mixing. A mixer for use herein may be the same as mentioned above.

The drying step is preferably performed so that the organic solvent evaporates and volatilizes sufficiently by heating at a temperature at which the organic solvent volatilizes and which is lower than the curing temperature of the silicone resin. Specifically, when the organic solvent is any of the alcohols and petroleum organic solvents, the drying is preferably performed at a temperature of about 60° C. to about 80° C. After drying, the resulting powder particles are preferably sieved through a sieve with an opening of about 300 μm to about 500 μm to remove aggregated undissolved lumps.

After drying, the silicone resin coating is preferably precured by heating the iron-based soft magnetic powder bearing the silicone resin coating formed thereon (silicone-resin-coated iron powder). As used herein the term "precuring" refers to a treatment which keeps the coated powder particles separate from one another upon curing of the silicone resin coating. In other words, the precuring permits the silicone-resin-coated iron powder to flow upon warm molding (warm compaction) (at about 100° C. to about 250° C.). Specifically, for the sake of simplicity, precuring may be performed by heating the silicone-resin-coated iron powder for a short time at a temperature near the curing temperature of the silicone resin; but precuring may also be performed with the help of an agent (curing agent). Difference between precuring and final curing (not precuring but complete curing) is that precuring does not completely bond powder particles together and allows powder particles to be pulverized easily, whereas final curing, which is carried out at high temperature after compaction of the powder, firmly bonds powder particles to each other. Thus, final curing helps the dust core to have higher strengths.

Precuring and subsequent pulverization (crushing) as described above yield an easily flowing powder that can be readily fed (like sand) into a die upon compacting. Without precuring, powder particles may be so sticky to one another upon warm molding as to impede the short-time supply of the powder particles into a die. Good handleability is essential in practical production process. It was found that precuring helps the dust core to have a significantly increased resistivity. While reasons remaining unclear, this is probably because precuring may help the iron-based soft magnetic powder particles to be more compact as the result of final curing.

Precuring by heating for a short time, when employed, may be accomplished by heating at 100° C. to 200° C. for 5 to 100 minutes, and preferably at 130° C. to 170° C. for 10 to 30 minutes. After precuring, the coated iron powder is preferably sieved in the same manner as mentioned above.

A powder including the iron-based soft magnetic powder and, formed thereon in the following order, a phosphate conversion coating film and a silicone resin coating has been described above in detail as an embodiment.

A dust core according to an embodiment of the present invention is obtained by compacting the iron-based soft magnetic powder. The compacting may be performed by any of known procedures not limited. Upon compacting, a lubricant may be added to the iron-based soft magnetic powder or may be applied to the die. The lubricant reduces friction among iron powder particles or allows iron powder particles to flow smoothly along the mold's inner wall upon compacting of the iron-based soft magnetic powder. This protects the die from damage by the dust core and suppresses heat generation upon compaction.

A lubricant, when employed, may be added to the iron-based soft magnetic powder in an amount of 0.2 percent by mass or more based on the total amount of the mixture of the iron-based soft magnetic powder and the lubricant. However, the lubricant is preferably used in an amount of 0.8 percent by mass or less, because excess lubricant is adverse to increase of the density of the dust core. An amount less than 0.2 percent by mass will be enough if a lubricant is applied to the inner wall of the die for compaction (die wall lubrication molding).

Any known lubricant can be used as the lubricant, which is exemplified by powders of metal stearates, such as zinc stearate, lithium stearate, and calcium stearate; polyhydroxycarboxamides; fatty acid amides such as ethylenebisstearamide and (N-octadecenyl)hexadecanamide; paraffins; waxes; and natural or synthetic resin derivatives. Among them, polyhydroxycarboxamides and fatty acid amides are preferred. Each of different lubricants may be used alone or in combination.

Exemplary polyhydroxycarboxamides include those represented by the formula: $C_mH_{m+1}(OH)_m$—CONH—$C_nH_{2n+1}$ where m is 2 or 5; and n is an integer of 6 to 24, as described in PCT International Publication Number WO2005/068588.

More specific examples include the following polyhydroxycarboxamides:

(1) n-$C_2H_3(OH)_2$—CONH-n-$C_6H_{13}$: (N-Hexyl)glyceramide
(2) n-$C_2H_3(OH)_2$—CONH-n-$C_8H_{17}$: (N-Octyl)glyceramide
(3) n-$C_2H_3(OH)_2$—CONH-n-$C_{18}H_{37}$: (N-Octadecyl)glyceramide
(4) n-$C_2H_3(OH)_2$—CONH-n-$C_{18}H_{35}$: (N-Octadecenyl)glyceramide
(5) n-$C_2H_3(OH)_2$—CONH-n-$C_{22}H_{45}$: (N-Docosyl)glyceramide
(6) n-$C_2H_3(OH)_2$—CONH-n-$C_{24}H_{49}$: (N-Tetracosyl)glyceramide
(7) n-$C_5H_6(OH)_5$—CONH-n-$C_6H_{13}$: (N-Hexyl)gluconamide
(8) n-$C_5H_6(OH)_5$—CONH-n-$C_8H_{17}$: (N-Octyl)gluconamide
(9) n-$C_5H_6(OH)_5$—CONH-n-$C_{18}H_{37}$: (N-Octadecyl)gluconamide
(10) n-$C_5H_6(OH)_5$—CONH-n-$C_{18}H_{35}$: (N-Octadecenyl)gluconamide
(11) n-$C_5H_6(OH)_5$—CONH-n-$C_{22}H_{45}$: (N-Docosyl)gluconamide
(12) n-$C_5H_6(OH)_5$—CONH-n-$C_{24}H_{49}$: (N-Tetracosyl)gluconamide The compaction is preferably performed at a surface pressure of 490 MPa to 1960 MPa. The compaction may be performed as either room-temperature compaction or warm compaction (at 100° C. to 250° C.). The compaction is preferably performed as warm compaction through die wall lubrication technique so as to give a dust core having higher strengths.

According to the present invention, a powder compact after compaction is subjected to a heat treatment. This reduces the hysteresis loss of the dust core. The heat treatment may be performed at a temperature of preferably 200° C. or higher, more preferably 300° C. or higher, and furthermore preferably 400° C. or higher. This step is desirably performed at an elevating temperature unless adversely affecting the resistivity. However, the heat treatment, if performed at a temperature of higher than 700° C., may cause breakage of the insulating coating. To avoid this, the heat treatment may be performed at a temperature of preferably 700° C. or lower and more preferably 650° C. or lower.

The atmosphere in the heat treatment is not limited and may be an air atmosphere or an inert gas atmosphere. The inert gas is typified by nitrogen gas; and rare gases such as helium and argon gases. The atmosphere may also be a vacuum atmosphere. The heat treatment time is not limited, unless adversely affecting the resistivity, but is preferably 20 minutes or longer, more preferably 30 minutes or longer, and furthermore preferably one hour or longer.

A heat treatment under the above-specified conditions enables production of a dust core having high electrical insulating properties, namely, high resistivity without increase in eddy current loss (corresponding to coercive force).

A dust core according to an embodiment of the present invention can be obtained by cooling the work after the heat treatment step down to room temperature.

Examples

The present invention will be illustrated in further detail with reference to several experimental examples below. It should be noted, however, that these examples are never construed to limit the scope of the invention and may be modified or changed without departing from the scope and sprit of the invention. All parts and percentages are by mass, unless otherwise specified.

An iron-oxide-based soft magnetic powder (matrix powder) as an oxide of pure iron powder was prepared by water atomization. This was sieved through a sieve having an opening of 45 μm, 75 μm, 100 μm, or 150 μm to remove particles of a size of 45 μm or less, 75 μm or less, 100 μm or less, or 150 μm or less, and thereby yielded size-controlled iron-oxide-based soft magnetic powders.

Particle sizes of each of the size-controlled iron-oxide-based soft magnetic powders were measured, and its distribution was determined. The particle sizes were measured by laser diffraction/scattering, and the particle size distribution was plotted with the abscissa indicating particle size and the ordinate indicating particle mass. In the measurement of the particle size, a mass-cumulative particle size $D_{10}$ was determined as a 10% mass-cumulative particle diameter for which 10% (by mass) of the entire particles in a sample powder are finer. The determined $D_{10}$s are indicated in Table 1 below.

Next, each of the size-controlled iron-oxide-based soft magnetic powders was subjected to thermal reduction at a temperature of 900° C. (Sample Nos. 6 to 8 in Table 1) or 1150° C. (Sample Nos. 1 to 4, 10, and 11 in Table 1) in a hydrogen atmosphere and yielded partially sintered preforms.

The resulting partially sintered preforms were crushed with a pulverizer, sieved through a sieve, and thus-classified powders were suitably mixed to give iron-based soft magnetic powders having an average particle size of 136 μm (Sample Nos. 10 to 12 in Table 1) or 183 μm (Sample Nos. 1 to 9 in Table 1), which average particle size was determined from the respective particle sizes and mass percentages thereof. The average particle sizes of the iron-based soft magnetic powders are also indicated in Table 1.

Next, dust cores were produced by using the prepared iron-based soft magnetic powders. Specifically, a phosphate conversion coating film and a silicone resin coating were formed in this order as insulating coatings on each of the iron-based soft magnetic powders, and the coated powders were used in production of dust cores.

The phosphate conversion coating film was formed using a phosphate conversion coating film composition which had been prepared by mixing 50 parts of water, 30 parts of $NaH_2PO_4$, 10 parts of $H_3PO_4$, 10 parts of $(NH_2OH)_2$—$H_2SO_4$, and 10 parts of $Co_3(PO_4)_2$ to give a mixture; and diluting the mixture twentyfold with water. Specifically, the coating composition was added in an amount of 50 ml per 1 kg of the iron-based soft magnetic powder, mixed therewith for 5 minutes or longer to give a mixture, the mixture was dried at 200° C. in air for 30 minutes, sieved through a sieve having an opening of 300 μm, and thereby yielded a phosphate-coated iron powder.

The silicone resin coating was formed using a resin solution prepared by dissolving a silicone resin "SR2400" (Dow Corning Toray Co., Ltd.) in toluene and having a resin solid content of 5%. Specifically, the resin solution was applied to the above-prepared phosphate-coated iron powder so as to give a mixture having a resin solid content of 0.05%, the mixture was heated in an oven at 75° C. in air for 30 minutes, and thereby yielded a silicone-resin-coated iron powder.

Interface densities were measured on the prepared iron-based soft magnetic powders (insulator-coated iron-based powders) bearing insulating coatings (phosphate conversion coating film and silicone resin coating).

Each of the prepared insulator-coated iron-based powders was embedded in a resin, cut to expose a cross section of the iron-based powder, the cross section was polished to a mirror-smooth state, the polished cross section was etched with a nital solution, the etched cross section was observed with an optical microscope at a 200-fold magnification, a picture thereof was taken and image-analyzed. The image analysis was performed using an image processing program "Image-Pro Plus" (Media Cybernetics, U.S.A.). The cross-sectional area and cross-sectional circumference of each iron-based powder were measured through image analysis. The measurement was performed on 100 particles of each sample iron-based powder and averaged, to calculate the interface density of the sample iron-based soft magnetic powder. The calculation results are also indicated in Table 1.

Next, the prepared insulator-coated iron-based powder were compacted using a press machine at room temperature (25° C.) through die wall lubrication at a surface pressure of 1177 MPa (12 ton/cm$^2$) and thereby yielded powder compacts. The powder compacts were in ring form with a size of 32 mm in outer diameter by 28 mm in inner diameter by 4 mm in thickness.

The prepared ring powder compacts were subjected to a heat treatment at 600° C. in a nitrogen atmosphere for 30 minutes and yielded dust cores. Heating to 600° C. was performed at a rate of temperature rise of about 10° C. per minute.

Subsequently, the prepared dust cores were cut to expose cross sections, the cross sections were mechanically polished with an emery paper, and buffed to a mirror-smooth state. Each of the mirror-smoothed cross sections was observed under an optical microscope at a 100-fold magnification, and the numbers of discontinuous particle interfaces were counted, which discontinuous particle interfaces had been formed in particles of the iron-based soft magnetic powder observed in an observation field of view. Observation was performed at five fields of view per each sample, the counted numbers were averaged to calculate a number density of discontinuous particle interfaces per square millimeter of the observation field of view. The results are indicated in Table 1.

FIG. 7 depicts an optical photomicrograph of a cross section of a dust core, which was taken on the cross section of the dust core of No. 2 in Table 1.

Next, coercive force of each of the prepared dust cores was measured to evaluate magnetic properties. The coercive force of a sample dust core was measured with a direct-current magnetic measurement system "BHS-40CD" (Riken Denshi Co., Ltd.) at a temperature of 25° C. with a maximum applied magnetic field (B) of 10000 A/m. The measurement results are also indicated in Table 1. A sample having a coercive force of 145 A/m or less was evaluated as accepted herein, whereas a sample having a coercive force of more than 145 A/m was evaluated as rejected.

For Sample Nos. 5, 9, and 12 in Table 1, the matrix powder was subjected to thermal reduction at 900° C. (Sample No. 9) or 1150° C. (Sample Nos. 5 and 12) in a hydrogen atmosphere to give partially sintered preforms, the partially sintered preforms were crushed with a pulverizer, sieved through sieves, the classified powder particles were suitably mixed to give powders having an average particle size of 136 μm (Sample No. 12) or 183 μm (Sample Nos. 5 and 9). The particle size $D_{10}$ before thermal reduction, thermal reduction temperature, average particle size after size control, and interface density of the thus-prepared powders are indicated in Table 1. Ring powder compacts were produced by the above procedure, except for using the prepared powders, and subjected to a heat treatment under the above conditions to give dust cores, and the coercive force thereof was measured. The measurement results are indicated in Table 1.

Table 1 indicates as follows. Sample Nos. 1 to 4, 6 to 8, 10, and 11 were samples satisfying conditions specified in the present invention, had been produced by thermal reduction of iron-oxide-based soft magnetic powders whose particle size being suitably controlled, and gave iron-based soft magnetic powders having interface densities each controlled to a predetermined level or lower. As a result, the iron-based soft magnetic powders gave dust cores having a low coercive force and exhibiting better magnetic properties. When the cross sections of the prepared dust cores were observed, the dust cores had a number density of discontinuous particle interfaces of 200 or less per square millimeter of an observation field of view, where the discontinuous particle interfaces were observed in iron-based soft magnetic powder particles present in a cross section of a sample dust core and were each derived from a surface of one iron-based soft magnetic powder particle and formed through contact of different regions of the surface with each other.

Comparisons among Sample Nos. 1 to 4 indicate that an iron-based soft magnetic powder has a lower coercive force and better magnetic properties with a decreasing interface density of the material iron-based soft magnetic powder. A similar tendency can be read from comparisons among Sample Nos. 6 to 8 and comparisons between Sample Nos. 10 and 11.

By contrast, Sample Nos. 5, 9, and 12 were samples not satisfying the conditions specified in the present invention, had been produced by subjecting the matrix powder (iron-oxide-based soft magnetic powder) to a thermal reduction without size control of the matrix powder, and thereby yielded iron-based soft magnetic powders having high interface densities. As a result, they gave dust cores having a large coercive force and failing to be improved in magnetic properties, even though the average particle size was controlled to be 136 μm or 183 μm in the same manner as above. When the cross sections of the prepared dust cores were observed, the dust cores had a number density of discontinuous particle interfaces of more than 200 per square millimeter of an observation field of view, where the discontinuous particle interfaces were observed in iron-based soft magnetic powder particles present in a cross section of the dust core.

These data demonstrate that iron-based soft magnetic powders, when allowed to have a low interface density, can give dust cores which have a low coercive force and exhibit better magnetic properties; and that dust cores can have a lower coercive force and exhibit better magnetic properties with a decreasing number density of discontinuous particle interfaces observed in the iron-based soft magnetic powders upon observation of cross sections of the dust cores.

TABLE 1

| Sample Number | How to control $D_{10}$ | $D_{10}$ (μm) | Thermal reduction temperature (° C.) | Average particle size (μm) | Interface density ($10^{-2}$ $\mu m^{-1}$) | Number density of discontinuous particle interfaces (per square millimeter) | Coercive force (A/m) |
|---|---|---|---|---|---|---|---|
| 1 | Removal of particles of 150 μm or less | 170 | 1150 | 183 | 1.8 | 60.0 | 109.6 |
| 2 | Removal of particles of 100 μm or less | 120 | 1150 | 183 | 2.1 | 114.0 | 121.6 |
| 3 | Removal of particles of 75 μm or less | 90 | 1150 | 183 | 2.3 | 142.0 | 129.1 |
| 4 | Removal of particles of 45 μm or less | 60 | 1150 | 183 | 2.4 | 152.5 | 134.2 |
| 5 | (Matrix powder without size control) | 20 | 1150 | 183 | 2.7 | 239.0 | 148.4 |
| 6 | Removal of particles of 100 μm or less | 120 | 900 | 183 | 1.9 | 79.5 | 113.5 |
| 7 | Removal of particles of 75 μm or less | 90 | 900 | 183 | 2.2 | 114.0 | 127.5 |
| 8 | Removal of particles of 45 μm or less | 60 | 900 | 183 | 2.3 | 138.5 | 138.1 |
| 9 | (Matrix powder without size control) | 20 | 900 | 183 | 2.7 | 211.5 | 150.4 |
| 10 | Removal of particles of 75 μm or less | 90 | 1150 | 136 | 2.4 | 168.5 | 131.8 |
| 11 | Removal of particles of 45 μm or less | 60 | 1150 | 136 | 2.5 | 194.5 | 142.5 |
| 12 | (Matrix powder without size control) | 20 | 1150 | 136 | 2.9 | 232.5 | 153.9 |

What is claimed is:

1. A method for producing an iron-based soft magnetic powder for a dust core, the method comprising:

preparing an iron-oxide-based soft magnetic powder through water atomization, controlling a particle size of the iron-oxide-based soft magnetic powder by sieve classification so as to have a mass-cumulative particle size $D_{10}$ of from 120 μm to 170 μm and by having an interface density of the iron-based soft magnetic powder of more than 0 $\mu m^{-1}$ and less than or equal to $2.1\times10^{-2}$ $\mu m^{-1}$, thereby reducing a coercive force of the iron-oxide-based soft magnetic powder; and thermally reducing the size-controlled iron-oxide-based soft magnetic powder at 900° C. or higher, thereby obtaining the iron-based soft magnetic powder, wherein the interface density is determined from a cross-sectional area ($\mu m^2$) and a cross-sectional circumference (μm) of the iron-based soft magnetic powder according to following Expression (1):

$$\text{Interface density}=\Sigma(\text{cross-sectional circumferences of iron-based soft magnetic powder particles})/2/\Sigma/(\text{cross-sectional areas of iron-based soft magnetic powder particles}) \quad (1).$$

2. The method of claim 1, further comprising controlling a particle size of the iron-based soft magnetic powder obtained from the thermal reduction, thereby obtaining an average particle size of 100 μm or more.

3. A method for producing a dust core, the method comprising:

compacting an iron-based soft magnetic powder produced by the method of claim 1 to give a powder compact; and thermally treating the powder compact.

4. The method of claim 1, comprising controlling the particle size by sieve classification and removing powder particles of 100 μm or less.

5. The method of claim 1, comprising controlling the particle size by sieve classification and removing powder particles of 150 μm or less.

* * * * *